United States Patent [19]

Campagnuolo et al.

[11] 3,990,370

[45] Nov. 9, 1976

[54] SAFETY DEVICE FOR BOMB FUSE CHARGING

[75] Inventors: Carl J. Campagnuolo, Potomac; Frank Vrataric, Jr., Wheaton, both of Md.; Ronald L. Dale, Destin; Earl Smith, Fort Walton Beach, both of Fla.

[73] Assignee: The United States of America as represented by the Secretary of the Army, Washington, D.C.

[22] Filed: Sept. 10, 1975

[21] Appl. No.: 612,051

[52] U.S. Cl. ..... 102/70.2 G; 102/2; 102/81.2

[51] Int. Cl.[2] ..... F42C 5/00; F42C 15/12

[58] Field of Search ..... 102/2, 70.2 G, 70.2 R, 102/81, 81.2; 89/1.5 D

[56] References Cited

UNITED STATES PATENTS

| | | | |
|---|---|---|---|
| 2,920,568 | 1/1960 | Rabinow | 102/70.2 G |
| 2,985,105 | 5/1961 | Rabinow et al. | 102/81.2 X |
| 3,093,076 | 6/1963 | Blomgren | 89/1.5 D |
| 3,382,805 | 5/1968 | Swaim | 102/81.2 |
| 3,401,635 | 9/1968 | Rabinow | 102/70.2 G |
| 3,757,695 | 9/1973 | Fisher | 102/70.2 G |

*Primary Examiner*—David H. Brown
*Attorney, Agent, or Firm*—Nathan Edelberg; Robert P. Gibson; Saul Elbaum

[57] ABSTRACT

Disclosed herein is an environmental charging system for providing energy to electrically fused bombs without the need for external charging equipment. The system comprises an electrically fused bomb having conventional existing charging well which charging well is usually centrally located along the longitudinal portion of the bomb. An energizing means, which is adapted to be actuated by slip stream air, is fixed within a charging device which is located within the charging well. The energizing means is designed to pop up out of the charging device as the bomb is released from the aircraft such that in its pop-up position it receives slip-stream air which in turn actuates the device. Means are provided for making electrical contact between the energizing means and the bomb only when the energizing means is in its pop-up position.

5 Claims, 2 Drawing Figures

SAFETY DEVICE FOR BOMB FUSE CHARGING

RIGHTS OF GOVERNMENT

The invention described herein may be manufactured, used and licensed by or for the United States Government for governmental purposes without the payment to the inventors of any royalty thereon.

BACKGROUND OF THE INVENTION

This invention relates generally to charging devices and, more particularly, to environmental charging systems that provide energy for electric bomb fuses and for safety features relating thereto.

Many of the electrical bomb fuses now in standard use require complex external charging equipment for providing electrical energy to the fusing system. In addition to their unwieldy structure, such equipment requires the use of special bomb mounting racks and plug in connectors not ordinarily found on aircraft. This type of charging gear occupies a great deal of space, which frequently precludes its use in special aircraft that use all existing space to accommodate other vital controlled equipment as needed.

The special electric charging gear in current use is installed and designed so that the electric bomb fuses are energized while falling from the aircraft just after release. Upon release, the charging gear is disengaged and the fuse becomes fully charged and ready for arming. The safety of the bomb is dependent on the reliability of the various safety devices in the fuse to prevent arming until the bomb has actually fallen a safe distance from the aircraft. A malfunction of the charging or releasing gear occurring, for example, while the plane is still on the ground, or while the plane is still carrying the bomb, would lead to a premature detonation causing serious injury to the aircraft and/or the crew members.

An environmental charging system for use with electric bomb fuses is disclosed in the U.S. Pat. No. 3,757,695 of Fisher, dated Sept. 11, 1973. This system, while representing a significant improvement over the prior art available at that time, nevertheless suffers from several deficiencies of its own. Basically, these problems stem from the fact that bombs must be used on several different types of aircraft which in turn have various bomb racks in existence, thereby producing various gap heights between the bomb and the rack. Accordingly, a situation sometimes occurs in which the energizing means (or the turbine alternator or generator) which is situated within the charging well of the bomb sometimes is so situated as to be in a partially open position. That is, a sufficient air gap exists so as to permit the entry of slipstream air into the alternator even while the bomb is physically attached to the aircraft and prior to release. The result is that the energizing device may be functioning and producing electrical power prior to release of the bomb. This condition obviously sets up a situation in which the bomb may possibly detonate prior to its release from the aircraft.

Accordingly, a primary object of the present invention is to provide a charging system for electric bomb fuses that positively will not energize the fuse until the bomb has been released from the aircraft and has achieved a prescribed minimum velocity.

Another object of the invention is to provide a charging system that is reliable, fool proof, easily adaptable to existing bomb structures, and has a minimum of moving parts.

A further object of the invention is to provide a charging system for electric bomb fuses that requires no special mounting racks or connectors for its utilization in existing bomb structures.

Still a further object is to provide an electric bomb charging device that is dependent for its actuation upon the positive release of the bomb from the aircraft.

SUMMARY OF THE INVENTION

Briefly, in accordance with this invention, an environmental charging system is provided for actuating electrically fused bombs with complete safety. An electrically fused bomb having an existing charging well which is generally centrally located is provided with an energizing means capable of actuation by slipstream air. Means are provided for causing the energizing element to pop up out of the charging well so as to receive the slipstream air upon release of the bomb from the aircraft. Means are also provided for making electrical contact between the energizing means and the fuse function of the bomb only when the energizing means is in its pop-up position. Finally, the energizing means is designed to remain in its pop-up position without falling back into the charging well.

BRIEF DESCRIPTION OF THE DRAWINGS

The specific nature of the invention, as well as other objects, aspects, uses and advantages thereof will clearly appear from the following description and from the accompanying drawing, in which.

DESCRIPTION OF THE PREFERRED EMBODIMENT

Figure 1:
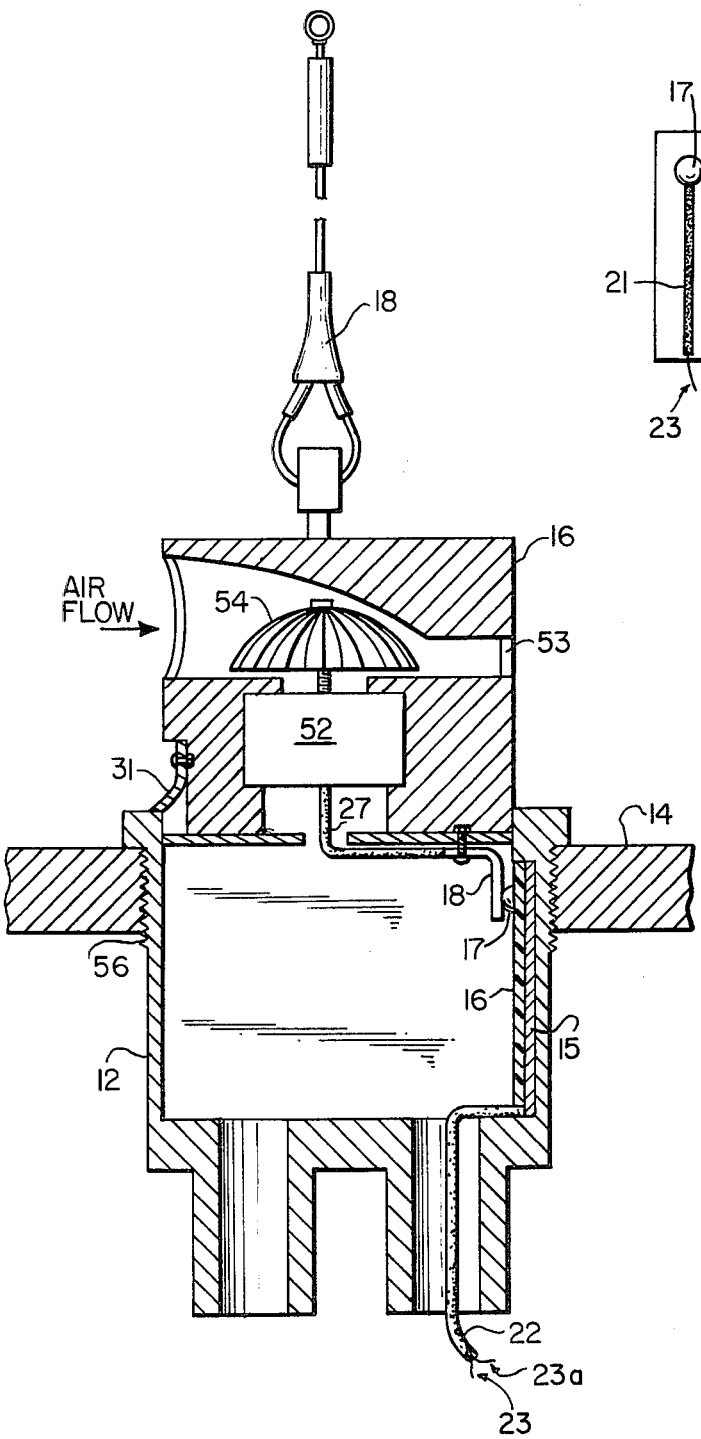
FIG. 1 is a cross-sectional view of an embodiment of the present invention.

Referring now to FIG. 1, the environmental charging device 12 is depicted as being situated within charging well 14 of a conventional electrically fused bomb. Charging device 12 provides electrical power by means of a multi-wire cable 22 to an electric bomb fuse located elsewhere.

Upon release of the bomb, energizing means 16 is caused to pop up out of the charging device 12 by means of a lanyard 18 which is attached to the aircraft. Exposure of the energizing means 16 to the slipstream air that flows past the bomb actuates the generator within the energizing device in a manner well known and fully described in the aforesaid patent. Briefly, a multipole alternator 52 is driven by an anemometer type vane 54. The alternator is designed such that a magnetic lock of the rotor will prevent rotation of vane 54 until a preselected minimum air velocity is attained due to the slipstream air. Excess air is exhausted to the atmosphere through vent 53. As an alternative arrangement, vane 54 can be replaced by a conventional and well known resonant cavity arrangement which is also described in the aforesaid patent.

Referring again to FIG. 1, the electrical energy generated within alternator 52 is transmitted through cable 27 to L shaped electrical connector 18 which makes contact with electrically conducting rivet 17. Rivet 17 extends through insulating cover 16 and makes electrical contact with an electrical conductor 15 which extends the full length of the charging device. At the bottom of the device electrical conductor 15 makes contact with multiwire cable 22 and wires 23 and 23*a* extend therefrom.

Figure 2:
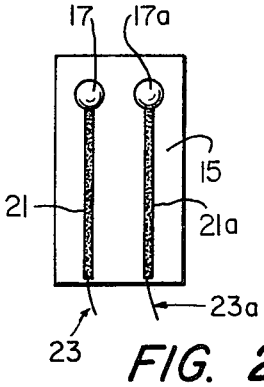
FIG. 2 illustrates a detailed element of the invention shown in FIG. 1.

The arrangement can be better understood with reference to FIG. 2 which shows the details of electrical conducting plate 15. Actually, plate 15 contains two electrical conductors 21 and 21*a* (which may be in the form of an electrically conductive coating). These electrical conductors connect electrically conductive rivets 17 and 17*a* to wires 23 and 23*a*. It will be appreciated then that the two electric wires leading from alternator 52 connect to two L shaped electrical connectors 18 which in turn make contact with two rivets 17 and 17*a* which in turn make contact through insulator 16 to two electrically conductive elements 21 and 21*a* and finally to wires 23 and 23*a*. It will be appreciated that when the energizing element 16 is in its closed position, L shaped connectors 18 are insulated from conductive coatings 21 and 21*a* by means of insulator 16. Only when the energizing means 16 is in its fully open (pop-up) position can electrical contact between the alternator 52 and the fusing device be completed. Accordingly, a unique safety device has been provided to prevent premature charging of the fusing element during the time that the bomb is physically connected to the aircraft.

An additional safety feature of the device is the self-biased spring 31 which pops up out of its groove when the energizing element 16 is fully opened. This self-biased spring then provides physical interference between the energizing element 16 and the charging well 14 (which holds the charging device 12 by means of threaded screw 56) such that the energizing element 16 cannot fall back into its cavity once it is in its pop-up position.

It will be appreciated that the present invention has provided for an arrangement in which, regardless of the rack in which the bomb is used, electrical power is available from the alternators only when the bomb is released and free from the aircraft. Any other situation such as a partially open housing condition will not permit the delivery of electrical power to the fuse by virtue of the fact that electrical connection cannot be made.

While one exemplary embodiment has been illustrated, it should be understood that the invention is not to be limited to the exact details of construction shown and described, because obvious modifications and changes can be made by persons skilled in the art.

We claim as our invention:

1. An environmental charging system for providing energy to electrically fused bombs without the use of external charging equipment comprising:

a. an electrically fused bomb having an existing charging well, said charging well being centrally located along the longitudinal portion of the bomb;
b. a charging device located within said charging well;
c. a slipstream actuated energizing means located within said charging device;
d. means for causing said energizing means to pop up out of said charging device so as to receive slipstream air input;
e. means for making electrical contact between said energizing means and said bomb only when said energizing means is in its pop-up position; and
f. means for maintaining said energizing means in its pop-up position.

2. The invention as defined in claim 1 wherein said means for maintaining said energizing means in its pop-up position comprises a self-biased spring which locks into place once the energizing means reaches its pop-up position.

3. The system defined in claim 1 wherein said means for making electrical contact comprises:

a. first and second electrical conductors disposed along at least one wall of said charging device;
b. an insulating material covering said electrical conductors so as to prevent electrical contact when said energizing means is in its closed position; and
c. third and fourth electrical conductors in contact with said first and second electrical conductors and protruding through said insulating material so as to allow electrical contact when said energizing means is in its pop-up position.

4. The invention defined in claim 3 wherein said third and fourth electrical conductors are electrically conductive rivets which protrude through the insulating material to make contact with the said first and second electrical conductors.

5. The invention defined in claim 4 wherein said means for making electrical contact further comprises L shaped electrically conductive elements which are spring biased so as to make electrical contact with said rivets when the energizing element is in its pop-up position.

* * * * *